US011859942B2

(12) United States Patent
Gann et al.

(10) Patent No.: US 11,859,942 B2
(45) **Date of Patent: *Jan. 2, 2024**

(54) ARCHERY BOW LIMB ASSEMBLY

(71) Applicant: MCP IP, LLC, Sparta, WI (US)

(72) Inventors: Brandon J. Gann, Sparta, WI (US); Mathew A. McPherson, Norwalk, WI (US)

(73) Assignee: MCP IP, LLC, Sparta, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/578,204

(22) Filed: Jan. 18, 2022

(65) Prior Publication Data

US 2022/0136795 A1 May 5, 2022

Related U.S. Application Data

(63) Continuation of application No. 16/661,842, filed on Oct. 23, 2019, now Pat. No. 11,226,166.

(60) Provisional application No. 62/750,047, filed on Oct. 24, 2018.

(51) Int. Cl.
*F41B 5/10* (2006.01)
*F41B 5/00* (2006.01)

(52) U.S. Cl.
CPC . *F41B 5/10* (2013.01); *F41B 5/00* (2013.01)

(58) Field of Classification Search
CPC ..... F41B 5/00; F41B 5/10
See application file for complete search history.

(56) References Cited

U.S. PATENT DOCUMENTS 3,674,001 A * 7/1972 Hitt ..... F41B 5/0005 273/DIG. 7
4,644,929 A * 2/1987 Peck ..... F41B 5/10 124/23.1
4,671,249 A * 6/1987 Troncoso ..... F41B 5/0057 124/23.1
5,377,658 A * 1/1995 Shepley, Jr. ..... F41B 5/10 124/88
5,429,106 A * 7/1995 Martin ..... F41B 5/0026 124/23.1
5,454,361 A * 10/1995 Bronnert ..... F41B 5/0094 124/23.1
5,720,267 A * 2/1998 Walk ..... F41B 5/10 124/23.1
5,722,380 A * 3/1998 Land ..... F41B 5/10 124/23.1
5,947,099 A * 9/1999 Derus ..... F41B 5/10 124/25.6
6,253,752 B1 * 7/2001 Cox ..... F41B 5/10 124/88
6,298,842 B1 * 10/2001 Sims ..... F41B 5/1426 267/136

(Continued)

*Primary Examiner* — John A Ricci
(74) *Attorney, Agent, or Firm* — Laabs Intellectual Property

(57) ABSTRACT

In some embodiments, an archery bow comprises a riser, a limb member and a support member. The limb member is supported by the riser at a first location. The limb member supports an axle at a second location. The support member is supported by the riser and arranged to support the limb member. The support member contacts the limb member at a contact location. The contact location is oriented between the first location and the second location along the length of the limb member.

18 Claims, 7 Drawing Sheets

(56) References Cited

U.S. PATENT DOCUMENTS

| | | | | |
|---|---|---|---|---|
| 6,367,464 | B1 * | 4/2002 | Bronnert | F41B 5/0068 124/23.1 |
| 6,684,870 | B1 * | 2/2004 | Land | F41B 5/1426 124/23.1 |
| 6,792,931 | B1 * | 9/2004 | Schaar | F41B 5/10 124/25.6 |
| 7,832,387 | B1 * | 11/2010 | Yehle | F41B 5/0094 124/23.1 |
| 8,459,244 | B2 * | 6/2013 | Yehle | F41B 5/0094 124/23.1 |
| 8,839,775 | B2 * | 9/2014 | Wasilewski | F41B 5/1426 124/89 |
| 10,359,253 | B2 * | 7/2019 | Peacemaker | F41B 5/1469 |
| 10,627,185 | B2 * | 4/2020 | Marriott | F41B 5/123 |
| 11,226,166 | B2 * | 1/2022 | Gann | F41B 5/00 |
| 2019/0128635 | A1 * | 5/2019 | McPherson | F41B 5/10 |

* cited by examiner

ARCHERY BOW LIMB ASSEMBLY

CROSS-REFERENCE TO RELATED APPLICATIONS

This application claims the benefit of U.S. patent application Ser. No. 16/661,842, filed Oct. 23, 2019, which claims the benefit of U.S. Patent Application No. 62/750,047, filed Oct. 24, 2018, the entire content of each of which is hereby incorporated herein by reference.

BACKGROUND OF THE INVENTION

This invention relates generally to archery and more specifically to archery bows.

Archery bows are known in the art and are used to launch arrows. As a bow is drawn, limbs are often flexed as energy is stored in the bow. When the bow is released, the stored energy is used to launch an arrow.

Archers desire a bow that is light in physical weight. Thus, it is desirable for an archery bow to have limbs that are as light as possible, but the limbs must be sufficiently strong and robust to withstand the forces at issue over the lifespan of the bow.

There remains a need for novel bow designs that provide improvements in weight and longevity.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, a limb assembly comprises a limb cup arranged to support a limb member at a first location. The limb member supports an axle at a second location. The limb cup supports a support member, which is arranged to apply a supporting force to the limb member at a support location. The support location is oriented between the first location and the second location.

In some embodiments, the support member comprises a roller and the roller contacts the limb member. In some embodiments, the support member comprises an axle and the axle supports the roller.

In some embodiments, the support member comprises a low friction material, which contacts the limb member.

In some embodiments, the support member contacts a compression side of the limb member.

In some embodiments, a limb assembly comprises a first limb member and the second limb member, and a support member is located between the first limb member and the second limb member.

In some embodiments, a limb cup comprises a first cavity, a second cavity and a third cavity. In some embodiments, the first limb member is oriented in the first cavity, the support member is oriented in the second cavity and the second limb member is oriented in the third cavity.

In some embodiments, an archery bow comprises a riser, a limb member and a support member. The limb member is supported by the riser at a first location. The limb member supports an axle at a second location. The support member is supported by the riser and arranged to support the limb member. The support member contacts the limb member at a contact location. The contact location is oriented between the first location and the second location along the length of the limb member.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
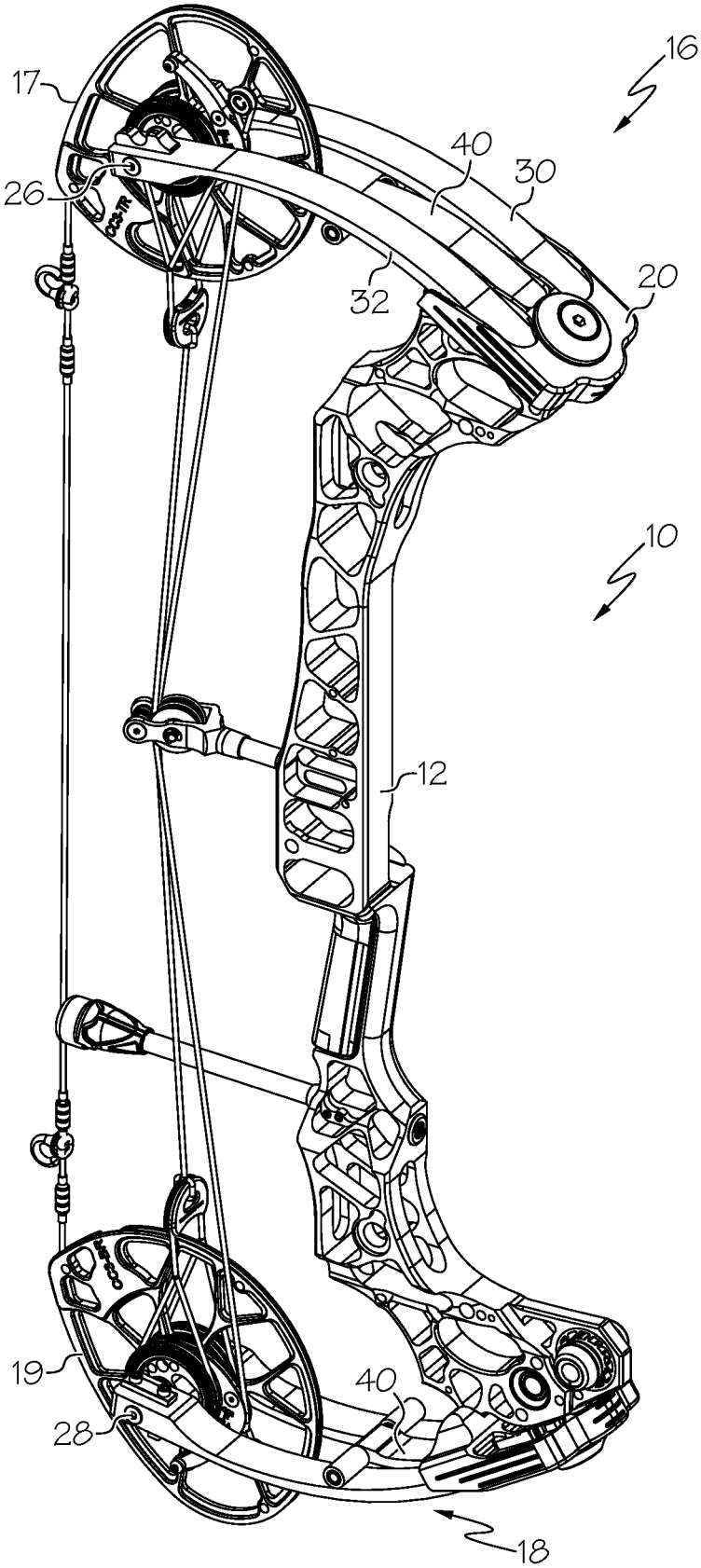
FIG. 1 show an embodiment of an archery bow.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

FIG. 1 shows an embodiment of an archery bow 10. In some embodiments, a bow 10 comprises a riser 12 arranged to support a first limb assembly 16 and a second limb assembly 18.

In some embodiments, a bow 10 comprises a non-compound bow (now shown) and a bowstring extends between the limb assemblies 16, 18.

In some embodiments, a bow 10 comprises a compound bow, for example comprising rotatable members and a compound cabling arrangement. In some embodiments, the first limb assembly 16 supports a first rotatable member 17 and the second limb assembly 18 supports a second rotatable member 19. In some embodiments, the first limb assembly 16 supports a first axle 26 and the first axle 26 supports the first rotatable member 17. In some embodiments, the second limb assembly 18 supports a second axle 28 and the second axle 28 supports the second rotatable member 19.

In some embodiments, the first limb assembly 16 comprises a first limb member 30 and a second limb member 32 that collectively support the first axle 26. In some embodiments, the second limb assembly 18 is configured similarly to the first limb assembly 16.

In some embodiments, the first limb assembly 16 comprises a support member 40. In some embodiments, the support member 40 is supported by the riser 12. In some embodiments, the support member 40 provides support to the first limb member 30. In some embodiments, the support member 40 provides support to the first limb member 30 and the second limb member 32.

Figure 2:
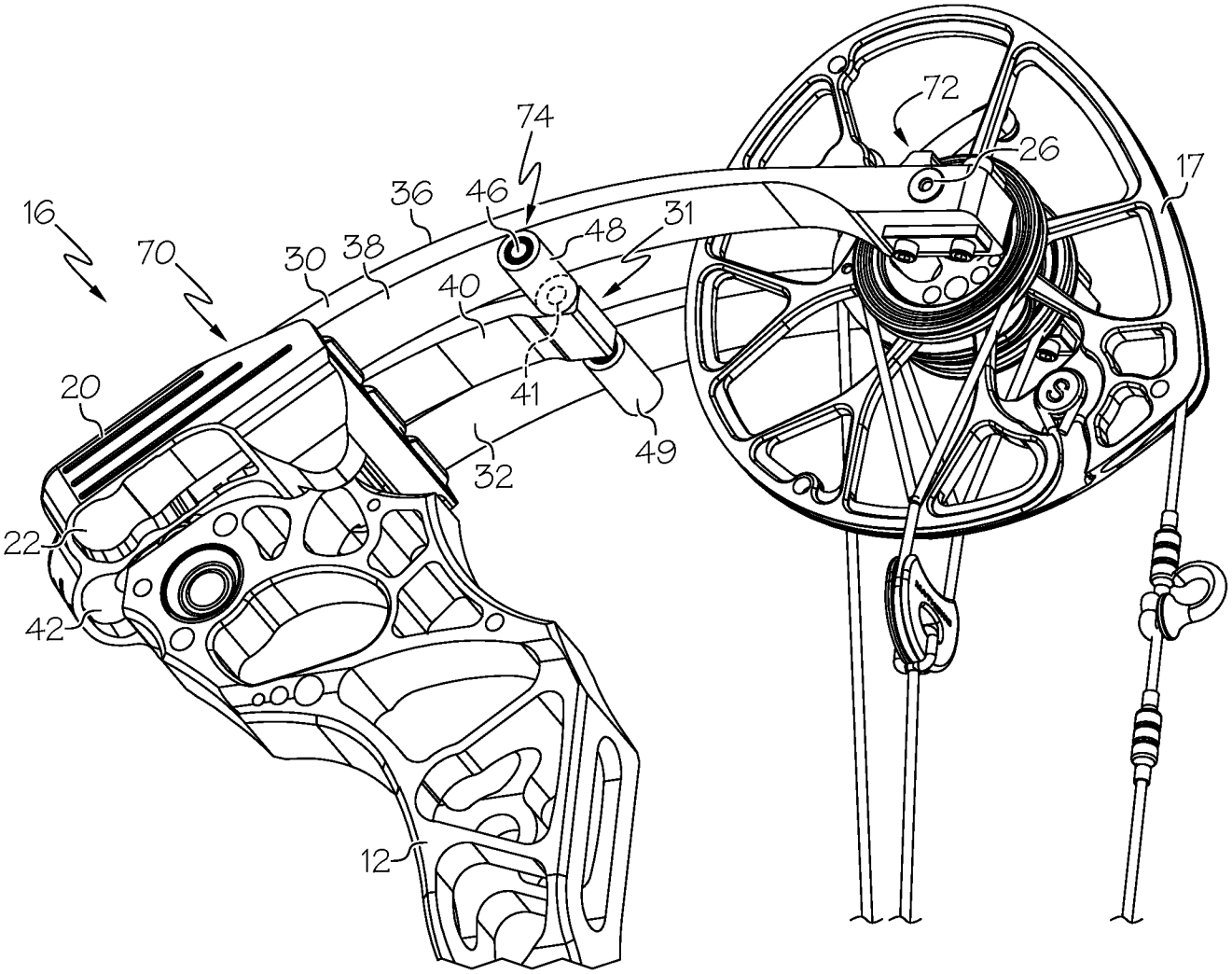
FIG. 2 shows a portion of the bow of FIG. 1 in greater detail.
Figure 3:
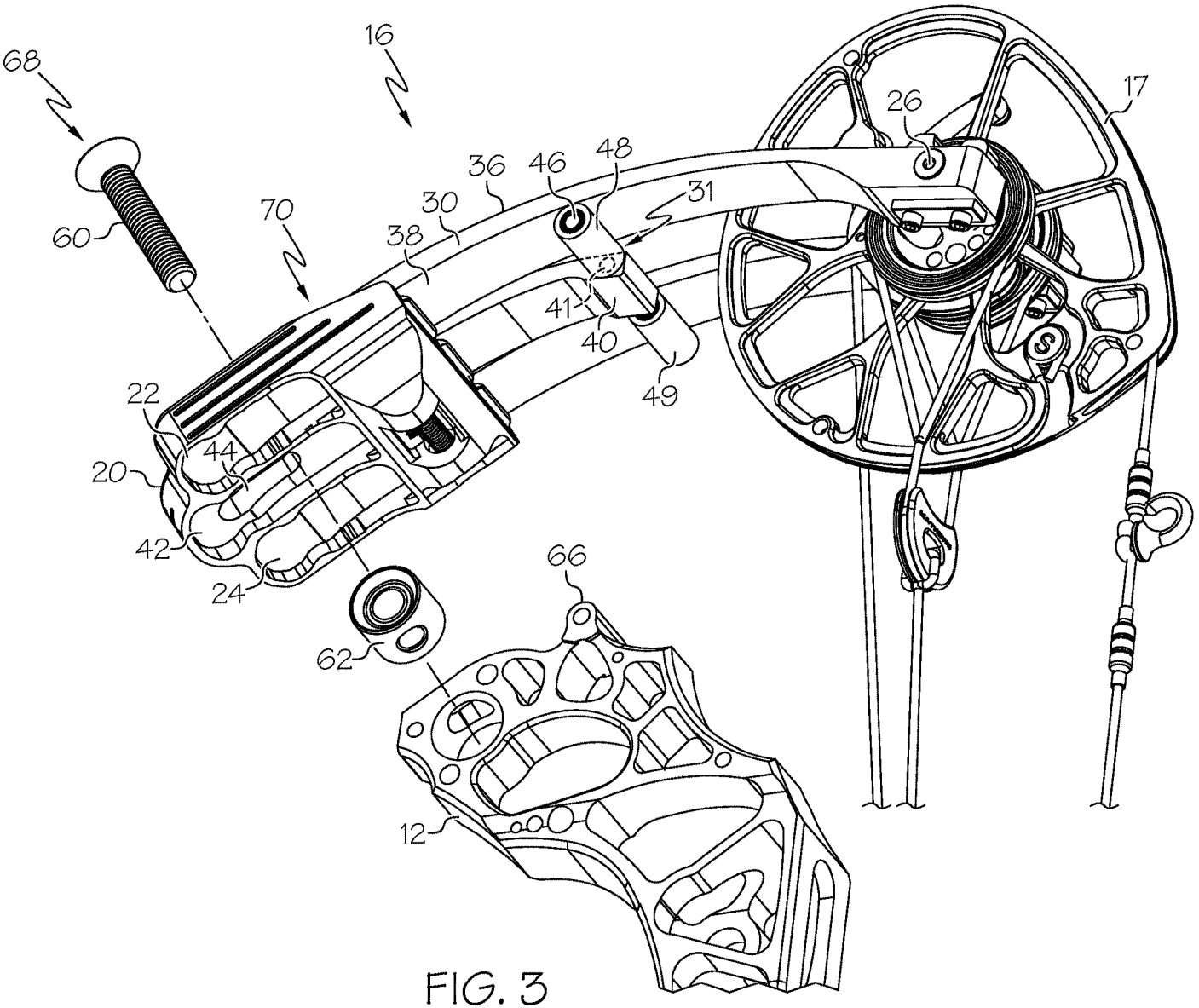
FIG. 3 shows an exploded view of an embodiment of a bow.

FIG. 2 shows an embodiment of a bow 10 in greater detail. FIG. 3 shows a similar view with the limb assembly 16 detached from the riser 12.

In some embodiments, a limb assembly 16 comprises a limb cup 20. In some embodiments, a limb cup 20 is supported by the riser 12. In some embodiments, the limb cup 20 supports the limb member(s) 30, 32. In some embodiments, the limb cup 20 supports the support member 40.

In some embodiments, the limb cup 20 and limb member(s) 30, 32 comprise features as disclosed in U.S. Pat. No. 8,453,635, the entire disclosure of which is hereby incorporated herein by reference.

In some embodiments, the limb cup 20 comprises a first cavity 22 for the first limb member 30 and a second cavity 24 for the second limb member 32.

In some embodiments, the limb cup 20 comprises a cavity 42 for the support member 40.

In some embodiments, each cavity 22, 24, 42 of the limb cup 20 comprises a protrusion/recess engaging arrangement with the respective limb member 30, 32 as disclosed in U.S. Pat. No. 8,453,635. In some embodiments, the protrusion/recess engaging arrangement is used with the support member 40.

In some embodiments, the support member 40 is engaged with the limb cup 20 at a location near the riser 12 and extends away from the limb cup 20 in the same direction as the limb member(s) 30, 32. In some embodiments, the first limb member 30 and second limb member 32 are spaced apart laterally defining a gap 31. In some embodiments, the support member 40 is positioned in the gap 31 between the limb members 30, 32.

In some embodiments, a length of the support member 40 is less than a length of the limb member(s) 30, 32. In some embodiments, an end of the support member 40 is aligned with a midportion of the limb member(s) 20, 32. In some embodiments, the support member 40 is arranged to support the midportion of the limb member(s) 20, 32.

In some embodiments, the support member 40 contacts the first limb member 30. In some embodiments, the support member 40 contacts the second limb member 32. In some embodiments, a limb member 30, 32 comprises a tension side 36 and a compression side 38, and the support member 40 contacts the compression side 38. In some embodiments, the support member 40 supports a crossmember or axle 46, and the axle 46 supports a limb member 30, 32. In some embodiments, the support member 40 comprises a cavity 41 and the axle 46 extends through the cavity 41. In some embodiments, a portion of the axle 46 located to a first side of the support member 40 supports the first limb member 30 and a portion of the axle 46 located to a second side of the support member 40 supports the second limb member 32.

In some embodiments, a support member 40 comprises a roller 48. In some embodiments, the roller 48 is arranged to contact the limb member 30. In some embodiments, the axle 46 supports the roller 48 and the roller 48 rotates with respect to the support member 40. In some embodiments, the support member 40 comprises a first roller 48 arranged to contact the first limb member 30 and a second roller 49 arranged to contact the second limb member 32.

In some embodiments, a bearing assembly, such as a roller bearing, is oriented between the axle 46 and a roller 48, 49. In some embodiments, a bearing assembly, such as a roller bearing, is oriented between the support member 40 and axle 46.

In some embodiments, the limb cup 20 comprises a first cavity 22 and a second cavity 24 that are aligned with one another, and a cavity 42 that is offset from the first and second cavities 22, 24 in at least one orthogonal direction. In some embodiments, ends of the first limb member 30 and second limb member 32 are aligned with one another in the limb cup 20, and an end of the support member 40 is offset from the ends of the limb members 30, 32.

In some embodiments, a limb cup 20 supports a limb member 30, 32 at a first location 70. In some embodiments, the first location 70 comprises a location where the limb cup 20 applies a supporting force to the compression side 38 of the limb member 30, 32. In some embodiments, a limb member 30, 32 supports an axle 26 at a second location 72. In some embodiments, a support member 40 is arranged to apply a force to a limb member 30, 32 at a support location 74. In some embodiments, a support location 74 comprises a location where the support member 40 applies a supporting force to the compression side 38 of the limb member 30, 32. In some embodiments, the support location 74 is oriented between the first location 70 and the second location 72 along the length of the limb member 30, 32.

Figure 4:
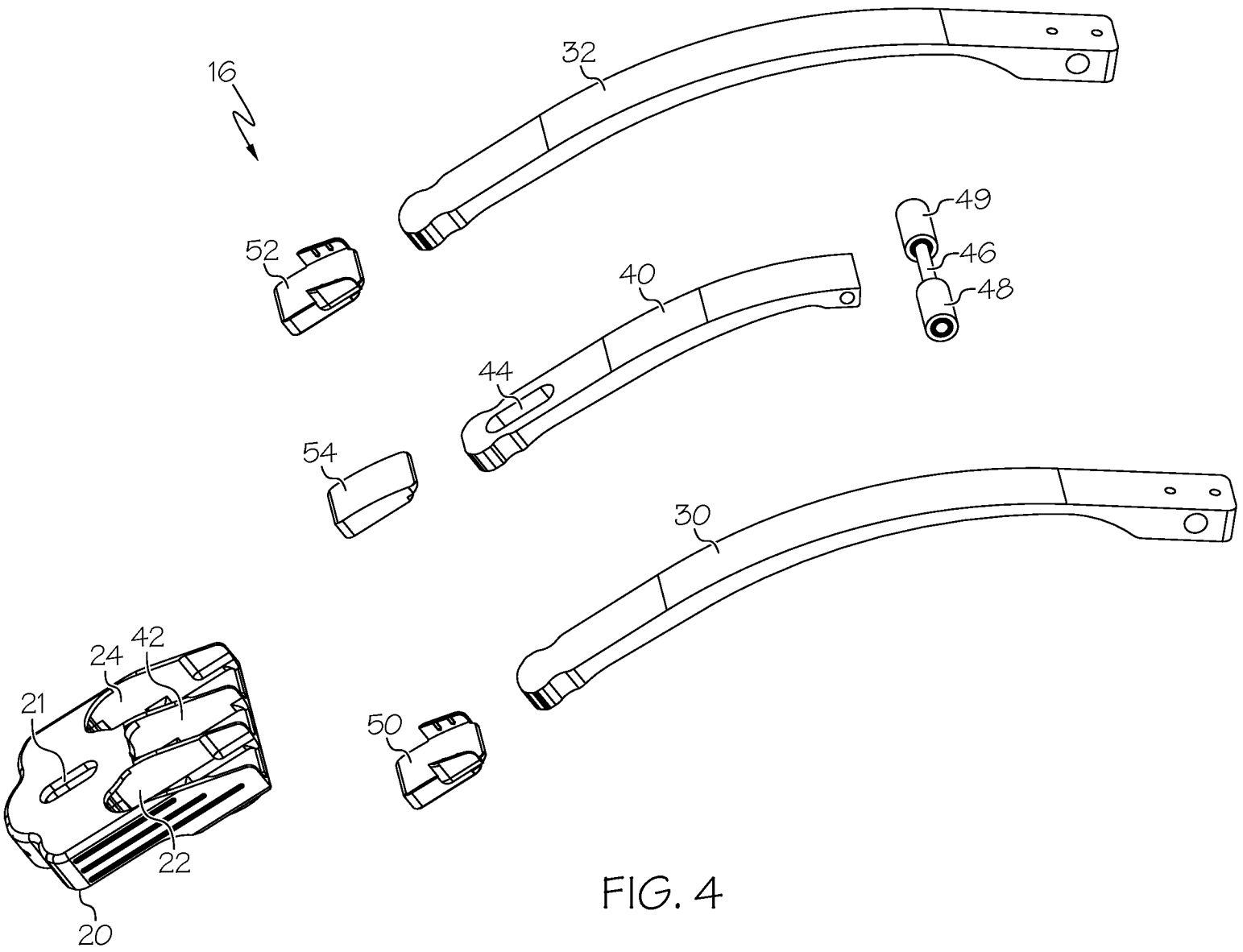
FIG. 4 shows an exploded view of an embodiment of a limb assembly.
Figure 5:
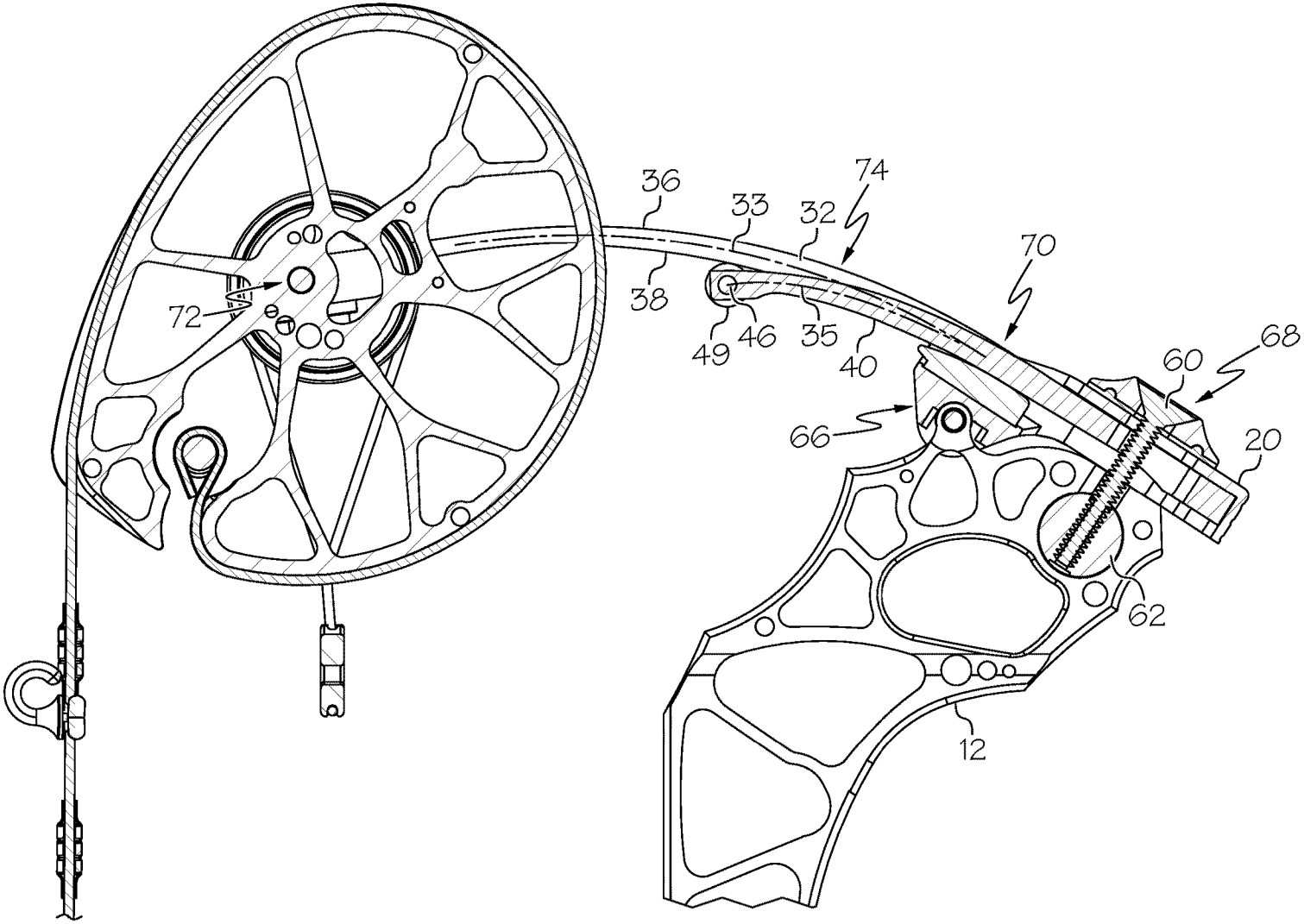
FIG. 5 shows a sectional view of an embodiment of a bow.

FIG. 4 shows an exploded view of an embodiment of a limb assembly 16. FIG. 5 shows a cross-sectional view of an embodiment of a bow 10.

With reference to FIGS. 3-5, in some embodiments, a limb assembly 16 is attached to the riser 12 via the limb cup 20. In some embodiments, the limb cup 20 is attached to the riser 12 with a moment connection comprising a compression portion and a tension portion. In some embodiments, the compression portion comprises a compression bearing 66. In some embodiments, the tension portion comprises a tension connection 68 comprising a limb bolt 60. In some embodiments, a limb bolt 60 engages a barrel nut 62 as known in the art.

In some embodiments, the support member 40 comprises an aperture 44 or cavity that provides clearance for the tension connection 68. In some embodiments, the support member 40 comprises an aperture 44 and a limb bolt 60 passes through the aperture 44. In some embodiments, the aperture 44 continues to an end of the support member 40 and comprises a slot formed in the end of the support member 40.

In some embodiments, the limb cup 20 comprises an aperture 21 for the limb bolt 60. In some embodiments, the aperture 44 in the support member 40 is aligned with the aperture 21 in the limb cup 20.

In some embodiments, the limb cup 20 comprises a first limb pad 50 for the first limb member 30 and a second limb pad 52 for the second limb member 32. In some embodiments, a limb pad 50, 52 comprises the first location 70 where the limb cup 20 supports a limb member 30, 32. In some embodiments, the limb cup 20 comprises a compression pad 54 for the support member 40. In some embodiments, the compression pad 54 is oriented in the cavity 42 of the limb cup 20 that receives the support member 40. In some embodiments, the compression pad 54 is shaped differently from the first limb pad 50. In some embodiments, the compression pad 54 is laterally aligned with the first limb pad 50 and the second limb pad 52.

In some embodiments, a longitudinal axis 33 of a limb member 30, 32 comprises curvature along its length. In some embodiments, a longitudinal axis 35 of a support member 40 comprises curvature along its length. In some embodiments, a longitudinal axis 35 of a support member 40 extends nonparallel to a longitudinal axis 33 of a limb member 30, 32. In some embodiments, the longitudinal axis 35 of a support member 40 comprises a curved portion comprising a higher degree of curvature than any portion of the longitudinal axis 33 of the limb member 30, 32. In some embodiments, the longitudinal axis 35 of a support member 40 and the longitudinal axis 33 of a limb member 30, 32 comprise portions that extend parallel with one another.

Figure 6:
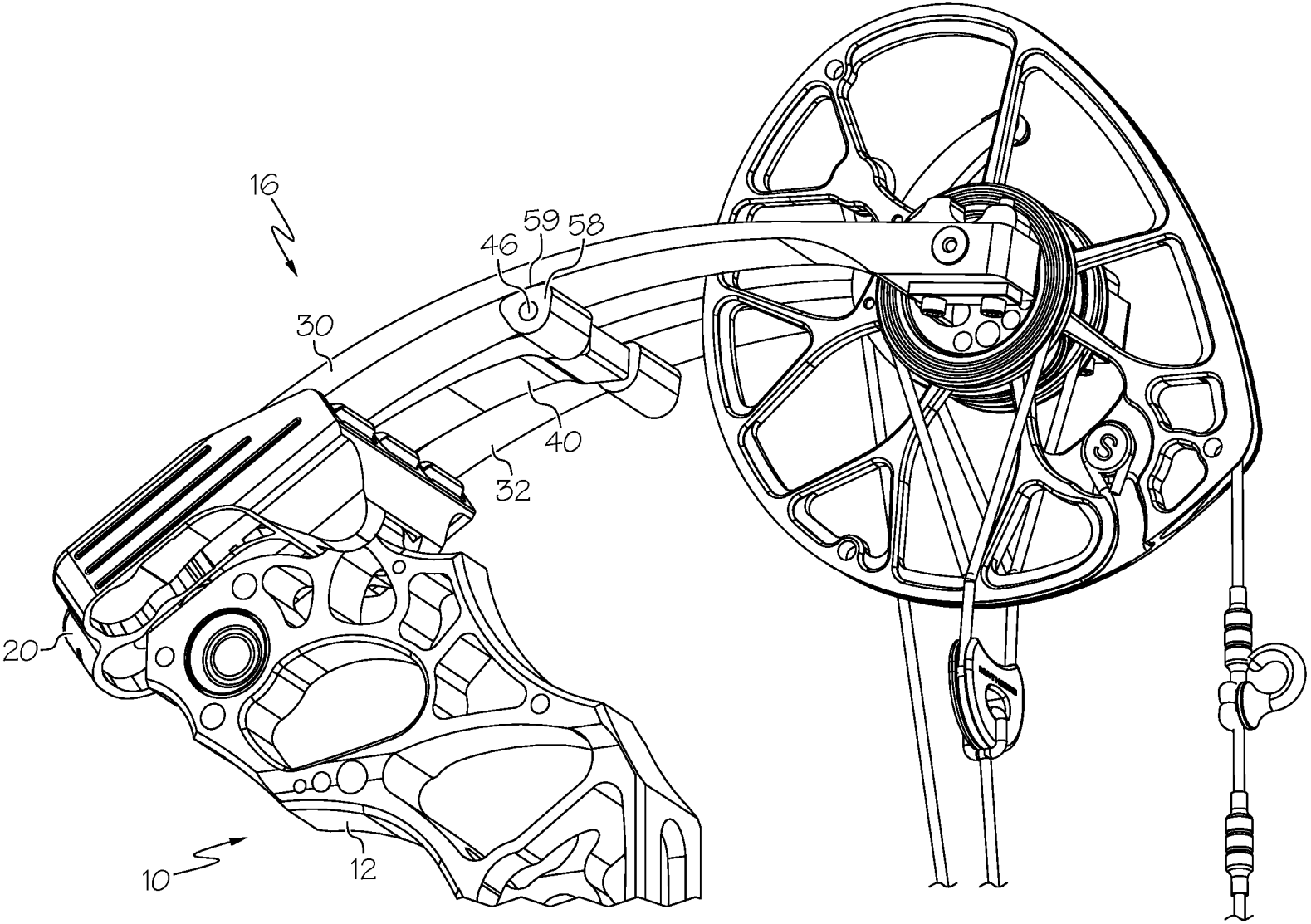
FIG. 6 shows another embodiment of a bow.

FIG. 6 shows another embodiment of a bow 10. In some embodiments, a support member 40 comprises a low friction pad 58 comprising a bearing surface 59 that contacts a limb member 30, 32. A low friction pad 58 desirably comprises a material having a lower coefficient of friction than material of the limb member 30, 32. In some embodiments, a pad 58 comprises PTFE or another suitable polymer comprising a relatively low coefficient of friction.

Figure 7:
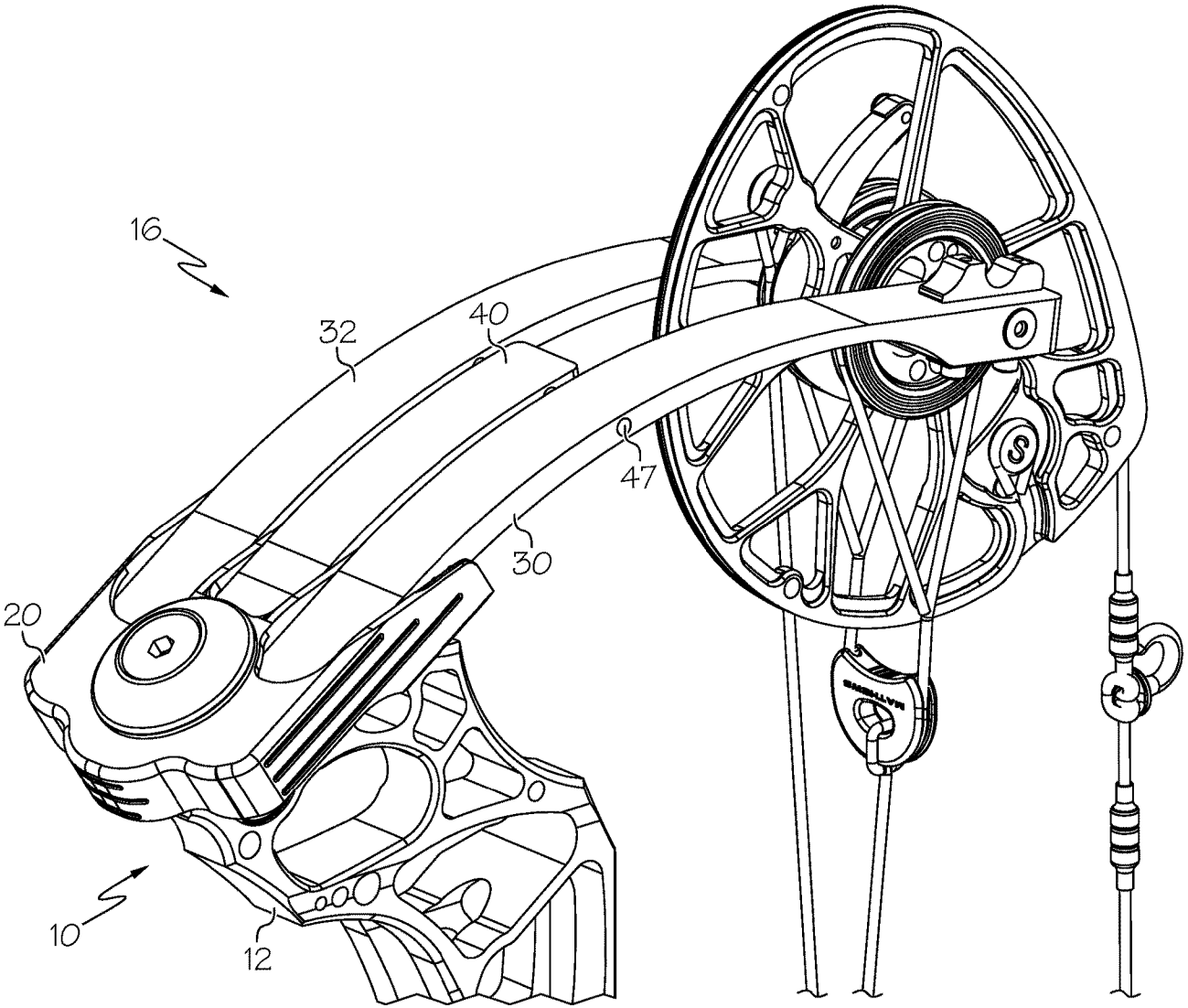
FIG. 7 shows another embodiment of a bow.

FIG. 7 shows another embodiment of a bow 10. In some embodiments, the support member 40 comprises a cross-member comprising a pin 47 that engages the limb members 30, 32. In some embodiments, the support member 40 supports the pin 47 and the pin 47 supports the limb members 30, 32. In some embodiments, a limb member 30, 32 comprises a cavity and the pin 47 is oriented in the cavity.

In some embodiments, the support member 40 extends from the limb cup 20 in a direction that is substantially parallel to the limb members 30, 32 and remains aligned with the limb members 30, 32 near the location of the pin 47. In some embodiments, an entire longitudinal axis 35 of a support member 40 extends parallel to a longitudinal axis 33 of a limb member 30, 32.

In some embodiments, a bow 10 can be provided with multiple support members 40 having different strength characteristics and changing the support members 40 can change the bow 10 without adjusting other components of the bow 10. For example, a bow 10 can be arranged with a first set of support members 40 to have a predetermined draw weight. The first set of support members 40 can be removed and replaced with a second set of support members 40, wherein the second set of support members 40 have a greater amount of strength than the first set. The bow 10 configured with the second set of support members 40 will have a higher draw weight, which is achieved without adjusting other portions of the bow 10, such as the limb members 30, 32, limb bolts, cams or cam modules, etc.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A limb assembly comprising:

a limb cup supporting a limb member at a first location;

the limb cup supporting a support member;

the limb member arranged to support an axle at a second location;

the support member arranged to apply a force to the limb member at a support location, the support location oriented between the first location and the second location, a longitudinal axis of the limb member oriented parallel to a longitudinal axis of the support member.

2. The limb assembly of claim 1, the support member comprising a first end and a second end, the first end supported by the limb cup, the second end arranged to apply the force to the limb member.

3. The limb assembly of claim 1, the support member comprising a pin, the pin engaged with the limb member.

4. The limb assembly of claim 1, the limb member comprising a first limb member, the limb cup supporting a second limb member, the second limb member arranged to support the axle.

5. The limb assembly of claim 4, the support member located between the first limb and the second limb.

6. The limb assembly of claim 4, the support member contacting the second limb member.

7. The limb assembly of claim 4, the limb cup comprising a first cavity, a second cavity and a third cavity.

8. The limb assembly of claim 7, the first limb member oriented in the first cavity, the support member oriented in the second cavity, the second limb member oriented in the third cavity.

9. A limb assembly comprising:

a limb cup supporting a limb member at a first location, the limb member comprising a first material;

the limb cup supporting a support member;

the limb member arranged to support an axle at a second location;

the support member arranged to apply a force to the limb member at a support location, the support location oriented between the first location and the second location;

the support member comprising a low friction material, the low friction material contacting the limb member, a coefficient of friction of the low friction material being less than a coefficient of friction of the first material.

10. The limb assembly of claim 9, the limb member comprising a tension side and a compression side, the support member contacting the compression side.

11. An archery bow comprising:

a riser;

a limb member supported by the riser at a first location, the limb member supporting an axle at a second location;

a limb bolt fastening the limb member to the riser; and a support member supported by the riser and arranged to support the limb member, the support member contacting the limb member at a contact location, the contact location oriented between the first location and the second location, the limb bolt extending through the support member.

12. The archery bow of claim 11, the support member contacting a compression side of the limb member.

13. The archery bow of claim 11, the support member comprising a roller, the roller contacting the limb member.

14. The archery bow of claim 13, the support member comprising an axle, the axle supporting the roller.

15. The archery bow of claim 11, wherein a longitudinal axis of the support member extends parallel to a longitudinal axis of the limb member.

16. The archery bow of claim 11, wherein a longitudinal axis of the support member comprises a higher degree of curvature than a longitudinal axis of the limb member.

17. The archery bow of claim 11, the support member comprising an aperture, the limb bolt extending through the aperture.

18. The archery bow of claim 11, comprising a limb cup, the limb bolt fastening the limb cup to the riser, the limb cup supporting the limb member.

* * * * *